US007988610B2

(12) United States Patent
Oki et al.

(10) Patent No.: US 7,988,610 B2
(45) Date of Patent: Aug. 2, 2011

(54) PARTICLE SEPARATION APPARATUS AND METHOD

(75) Inventors: Tatsuya Oki, Tsukuba (JP); Hiroki Yotsumoto, Tsukuba (JP); Mikio Kobayashi, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 984 days.

(21) Appl. No.: 11/781,465

(22) Filed: Jul. 23, 2007

(65) Prior Publication Data

US 2008/0023380 A1 Jan. 31, 2008

(30) Foreign Application Priority Data

Jul. 25, 2006 (JP) ..... 2006-202395
Jul. 13, 2007 (JP) ..... 2007-184742

(51) Int. Cl.
*B04B 1/04* (2006.01)

(52) U.S. Cl. ..... 494/37; 494/7; 494/43; 494/79

(58) Field of Classification Search ..... 494/7, 9–10, 494/31, 33, 37, 85, 16–17, 27–30, 43, 79–80; 210/781, 360.1, 380.1; 422/72
See application file for complete search history.

(56) References Cited

U.S. PATENT DOCUMENTS 4,874,358 A * 10/1989 Brimhall et al. ..... 494/37
7,727,136 B2 * 6/2010 Kim et al. ..... 494/37
2008/0023380 A1 * 1/2008 Oki et al.

FOREIGN PATENT DOCUMENTS

JP 63-62562 3/1988
JP 2003-340314 12/2003
JP 2006-239678 9/2006

* cited by examiner

*Primary Examiner* — Charles E Cooley
(74) *Attorney, Agent, or Firm* — Oblon, Spivak, McClelland, Maier & Neustadt, L.L.P.

(57) ABSTRACT

A particle separation apparatus includes a base, a disc-shaped container rotatable on the base at a constant speed and a suspension supply tank for separating in the container particles contained in a suspension supplied from the tank according to specific gravities or particle diameters of the particles. The container includes a plurality of centrifugation vessels disposed around a rotation axis and in a circumferential direction of the container, particle supply cylinders disposed at a center of the container for discharging the particles in the suspension toward the vessels and a lid, and has a structure controllable in rotational speed to adjust a distance of relative movement in a rotation direction between large-gravity particles and small-gravity particles. The vessels are individually in a form of dents independent of one another and are each formed of an inner circumferential wall and a bottom wall. Each of the cylinders has means for discharging the particles in the suspension toward a centrifugation vessel filled beforehand with water.

4 Claims, 7 Drawing Sheets

PRIOR ART
FIG.3(a)
PRIOR ART
FIG.3(b)
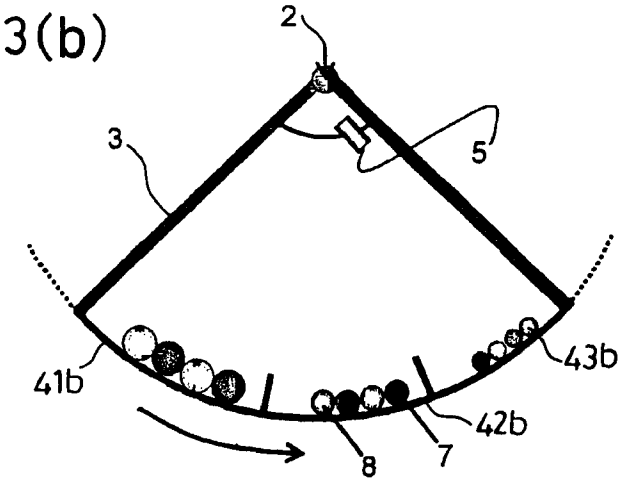
FIG.3(c)
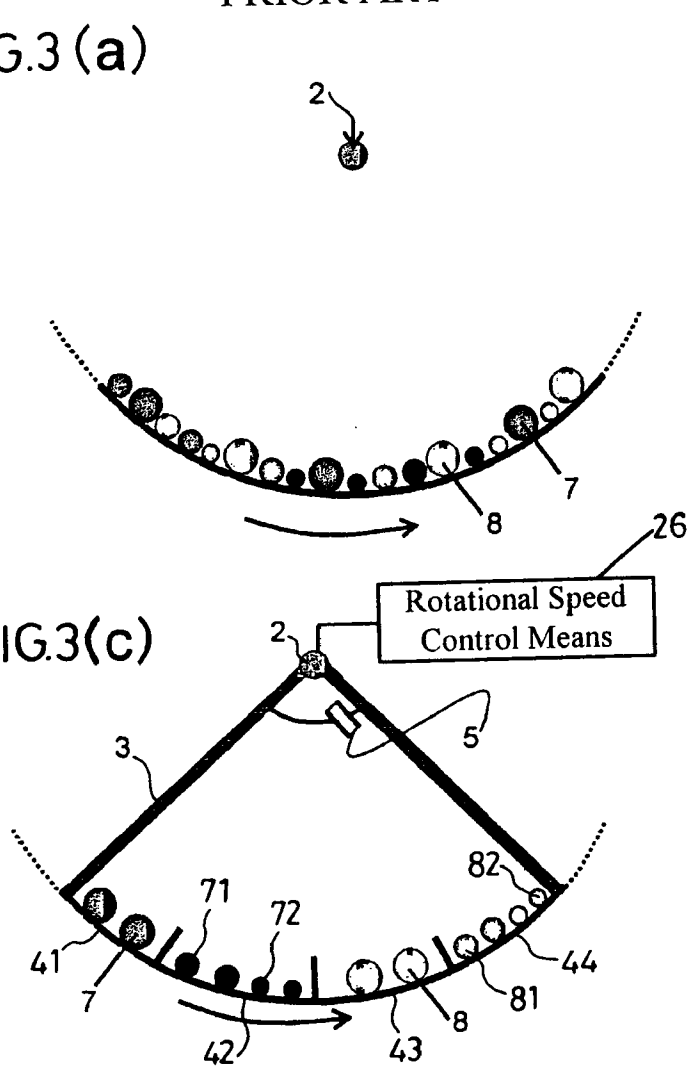
FIG.3(d)
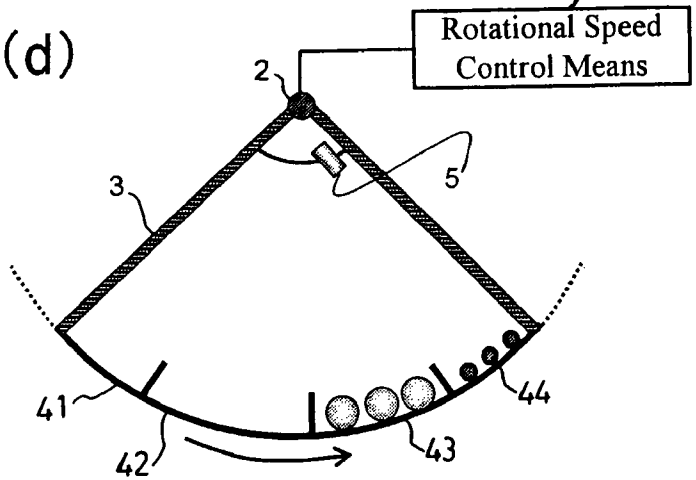

PARTICLE SEPARATION APPARATUS AND METHOD

BACKGROUND OF THE INVENTION

1. Field of the Invention

The present invention relates to a particle separation apparatus and method for separating particles in a suspension, with the specific gravities thereof or both the specific gravities and the particle diameters thereof as separation criteria.

2. Description of the Prior Art

Various particle separation apparatus using the specific gravities or particle diameters of two or more kinds of particles different in specific gravity as separation criteria and utilizing the difference in velocity of the underwater movements of the particles (jigs, tables, cyclones, etc. and their improvements) have heretofore been put to practical use at various places in the industrial fields.

The present inventors have already proposed a method for separating particles into large-gravity particles and small-gravity particles utilizing the difference in sedimentation velocity resulting from the difference in specific gravity of the particles, which method comprises giving a vibration in the direction in which the particles are settling down, utilizing the specific gravities of the particles and the frequencies and amplitudes of the vibration to make the sedimentation delay of the small-gravity particles larger than that of the large-gravity particles, thereby enlarging an equal settling ratio that is a particle diameter ratio of the particles different in specific gravity settling down at the same velocity (refer to JP-A 2003-340314).

In addition, a centrifugal separator having a structure in which a motor enables a partition wall to be rotated for solid-liquid-separating fine particles from a liquid has been known to the art (refer to JP-A SHO 63-62562).

Furthermore, the present inventors have already applied for a patent of the invention directed to means for separating fine particles every one group of particle diameters regardless of the difference in specific gravity, utilizing the application of centrifugal force under specific conditions (JP-A 2006-239678).

In a particle separation apparatus using the specific gravities or particle diameters of two or more kinds of particles different in specific gravity as separation criteria and utilizing the difference in velocity of the underwater movements of the particles, since the velocity of movement of the particles in water depends on both the specific gravities and the particle diameters (projected cross-sectional areas) of the particles, there are cases where particles of large gravity and small particle diameter and particles of small gravity and large particle diameter move at the same velocity and where particles of small gravity moves at a higher velocity than particles of large gravity.

In order to separate particles into groups different in specific gravity with high accuracy, therefore, it is required to remove in advance particles large particle diameter and small gravity higher in velocity than particles of large gravity and particles of small particle diameter and large gravity lower in velocity than particles of small gravity.

Since it is impossible to beforehand remove particles having specific particle diameters into groups different in specific gravity, it is generally adopted to use a method capable of separating with a sieve the particles according to the particle diameters regardless of the specific gravities to obtain particles adjusted to a specific particle size width range. While preparatory particle size adjustments to the range of approximately several millimeters to several centimeters are ready to make, it is very difficult to industrially adjust particles having particle diameters smaller than 50 to 100 μm to specific particle size widths.

Major conventional fine particle separation apparatus have been provided with a system applying a centrifugal field to increase the particle movement velocity. However, since the centrifugal force, as well as the gravitational force, is a force depending on both the specific gravities and the particle diameters of the particles, it has few effects on spreading of the particle size width to be preparatorily adjusted, as shown in FIG. 3(*a*), while it enables the time required for separation to be shortened.

With the prior art techniques, therefore, it has been impossible to separate fine particles, particularly, polydisperse fine particles with high precision according to specific gravities (or particle diameters). Means available to date for separating such polydisperse fine particles according to specific gravities with high precision utilizing the difference in underwater movement thereof include (1) a one-stage process comprising controlling the particle movement at the time of separation by the specific gravity to separate the fine particles according to the specific gravities with high precision regardless of the particle diameters or reducing the degree of particle-diameter dependency of the fine particles to be separated to enlarge the particle size width to be preparatorily adjusted, thereby actually dispensing with the preparatory particle size adjustment and (2) a two-stage process comprising establishing a technique capable of separating, according to the particle diameters with high precision regardless of the specific gravities, fine particles preparatorily adjustable to the particle size required for the separation according to the specific gravities and then performing an existing method of separation according to the specific gravities.

JP-A 2003-340314 cited above relates to a method comprising affording a specific vertical vibration to water to control the movement of particles in water, thereby enlarging the particle size width to be adjusted preparatorily. Thus, it corresponds to one-stage process (i) above and, since it has its limits on a variable particle size width, it is difficult to completely dispense with the particle size adjustment.

JP-A 2006-239678 cited above relates to a technique corresponding to two-stage process (2) above with the aim of solving the aforementioned conventional problem, and resorting to means for affording a centrifugal force under specific conditions to enable separation of the particles according to their particle diameters irrespective of the difference in specific gravity.

An object of the present invention is to provide a technique that further improves the technique disclosed in JP-A 2006-239678 and realizes a technique corresponding to two-stage process (2) above, in which a centrifugal force is given under specific conditions different from those used in JP-A 2006-239678 to thereby enable separation of fine particles according to their specific gravities or to both their particle diameters and their specific gravities.

SUMMARY OF THE INVENTION

To attain the above object, the present invention provides as the first aspect thereof a particle separation apparatus comprising a base, a disc-shaped container rotatable on the base at a constant speed and a suspension supply tank for separating in the disc-shaped container particles contained in a suspension supplied from the suspension supply tank according to specific gravities or particle diameters of the particles; the disc-shaped container including a plurality of centrifugation vessels disposed around a rotation axis and in a circumferential direction of the container, particle supply cylinders disposed at a center of the container for discharging the particles in the suspension toward the centrifugation vessels and a lid, and having a structure controllable in rotational speed to adjust a distance of relative movement in a rotation direction between large-gravity particles and small-gravity particles; the centrifugation vessels being individually in a form of dents independent of one another and each formed of an inner circumferential wall and a bottom wall; the particle supply cylinders each having means for discharging the particles in the suspension toward a centrifugation vessel filled beforehand with water.

In the second aspect of the invention that includes the first aspect, the disc-shaped container has a configuration enabling its rpm to be heightened to make a distance of movement of the large-gravity particles in a reverse rotation direction larger than that of the small-gravity particles and to make a distance of movement of the particles of same specific gravity in a reverse rotation direction larger in proportion as a particle diameter of the particles is increased, thereby enabling separation of the particles contained in the suspension according to the specific gravities or particle diameters of the particles.

In the third aspect of the invention that includes the first aspect, the disc-shaped container has a configuration enabling its rpm to be lowered to make a distance of movement of the small-gravity particles in a reverse rotation direction larger than that of the large-gravity particles and to make a distance of movement of the particles of same specific gravity in a reverse rotation direction larger in proportion as a particle diameter of the particles is increased, thereby enabling separation of the particles contained in the suspension according to the specific gravities or particle diameters of the particles.

In the fourth aspect of the invention that includes any one of the first to third aspects, the centrifugation vessel has an inner circumferential wall provided in an outer wall thereof with a plurality of pockets partitioned in a circumferential direction for collecting therein the separated small-gravity particles and large-gravity particles.

To achieve the above object, the present invention provides as the fifth aspect thereof a method for separating particles contained in a suspension using a disc-shaped container which is rotatable on a base at a constant rotational speed and which is provided with centrifugation vessels, comprising the steps of rotating the disc-shaped container on the base at a constant rotational speed, releasing the suspension into the centrifugation vessels filled beforehand with water, and changing a distance of relative movement in a rotation direction between large-gravity particles and small-gravity particles in accordance with the rpm of the disc-shaped container, thereby separating in the disc-shaped container the particles contained in the suspension according to specific gravities or particle diameters of the particles.

In the sixth aspect of the invention that includes the fifth aspect, the suspension is released via a particle supply cylinder of the disc-shaped container into the centrifugation vessels.

The seventh aspect of the invention that includes the fifth or sixth aspect further comprises the step of heightening the rpm to make a distance of movement of the large-gravity particles in a reverse rotation direction larger than that of the small-gravity particles and to make a distance of movement of the particles of same specific gravity in a reverse rotation direction larger in proportion as a particle diameter of the particles is increased, thereby enabling separation of the particles contained in the suspension according to the specific gravities or particle diameters of the particles.

The eighth aspect of the invention that includes the fifth or sixth aspect further comprises the step of lowering the rpm to make a distance of movement of the small-gravity particles in a reverse rotation direction larger than that of the large-gravity particles and to make a distance of movement of the particles of same specific gravity in a reverse rotation direction larger in proportion as a particle diameter of the particles is increased, thereby enabling separation of the particles contained in the suspension according to the specific gravities or particle diameters of the particles.

In the conventional technique for separating particles utilizing the difference in underwater movement of the particles, it has been required that the particles to be separated be uniform in particle diameter when performing the separation according to their specific gravities and that the particles to be separated be uniform in specific gravity when performing the separation according to their particle diameters. According to the present invention, however, it is made possible to separate with high precision particles having a wide range of specific gravities or particle diameters according to their specific gravities or particle diameters.

Furthermore, in the "particle separation method according to the specific gravities" (refer to JP-A 2003-340314, for example), since the particle diameters are limited to part of the diameters in the range of 10 to 100 μm and since the effect of the sedimentation delay by vibration is utilized, the method is disadvantageous in that the particle separation speed is made considerably slow. On the other hand, the present invention has no theoretical restrictions on the particle size and utilizes a centrifugal field to make the particle separation speed extremely quick.

The above and other objects, characteristic features and advantages of the present invention will become apparent to those skilled in the art from the description to be given herein below with reference to the accompanying drawings.

BRIEF DESCRIPTION OF THE DRAWINGS

FIG. 3(*a*) is an explanatory view showing the particle arrangement when using an ordinary centrifugal force-utilizing apparatus, FIG. 3(*b*) an explanatory view showing the particle arrangement when using the method disclosed in JP-A 2006-239678, and FIGS. 3(*c*) and 3(*d*) explanatory views showing the particle arrangements and movements within the centrifugation vessel in the disc-shaped container, as viewed from above, in the fundamental configuration and operation of the apparatus and method according to the present invention.

DETAILED DESCRIPTION OF THE PREFERRED EMBODIMENT

The method and apparatus of the present invention for separating particles contained in a suspension according to their specific gravities or particle diameters will be described hereinafter based on the embodiments with reference to the accompanying drawings.

The fundamental configuration and principle will be described though these are in common with those of JP-A 2006-239678. To be specific, in an ordinary centrifugal separator or cyclone having a container filled with a suspension containing particles, since the water is movable in the rotation direction, the Coriolis force ("apparent force" acting in the reverse rotation direction) is exerted onto both the water and the particles rotating. Since the Coriolis force has something to do with a descent in centrifugal separation speed, countermeasures against it have been considered.

It has already been known radial confining walls provided within a disc-shaped container (refer to JP-A SHO 63-62562) allows the centrifugal force to efficiently act on the particles because the water is prevented from rotating, thereby preventing a descent in centrifugal separation speed. The particle separation apparatus of the present invention, though similar apparently to a centrifugal separator having the radial confining walls, differs in separation conception from it and enables the particles to be separated according to the particle diameters by obstructing comings and goings of the water and changing how to supply and collect the particles. This will be described with reference to FIG. 1 that is a conceptual view and FIG. 2 that is an operation-explaining view.

Figure 1:
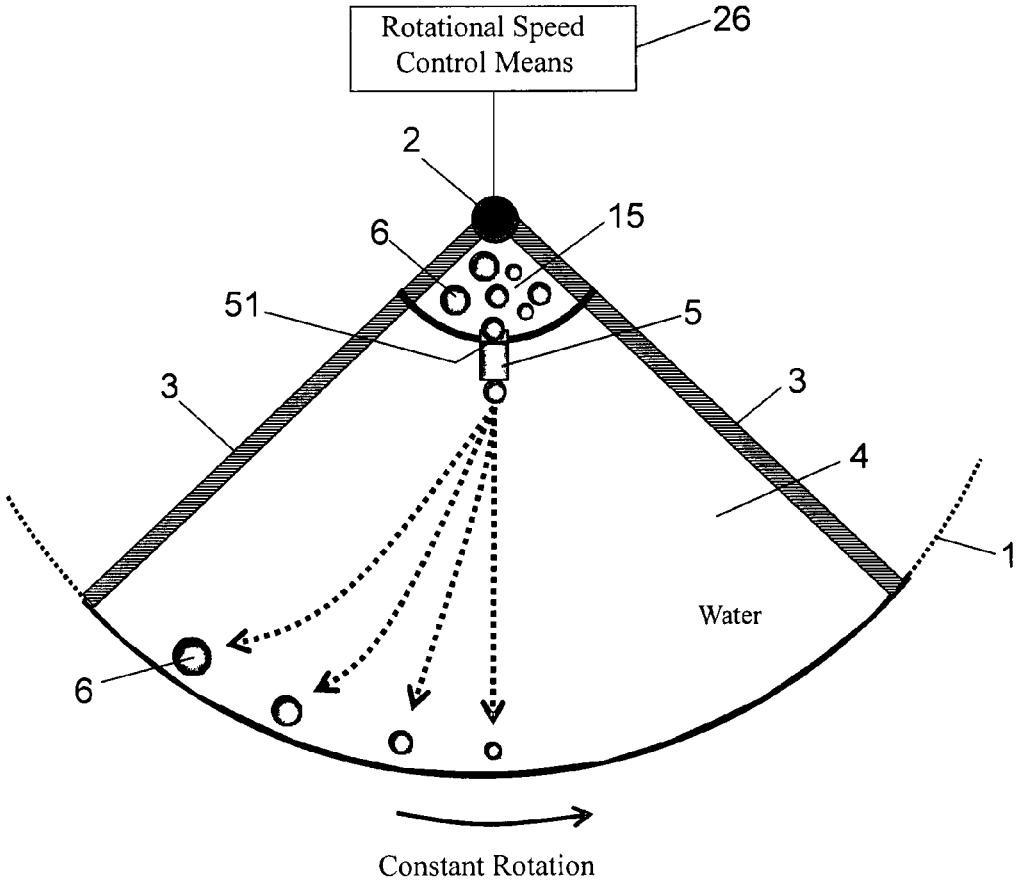
FIG. 1 is an explanatory view showing the fundamental configuration of the particle separation apparatus and the fundamental operation of the particle separation method according to the present invention.

As shown in the conceptual view of FIG. 1, a disc-shaped container 1 is filled with limpid water, provided with a fan-shaped compartment 4 using radial confining walls 3, with a rotating shaft 2 for the disc-shaped container 1 as the center, to enable prevention of comings and goings of the water and rotated in one direction, with the rotating shaft 2 as the center. Otherwise, a container having an arbitrary shape is filled with limpid water and rotated in one direction around a rotating shaft provided outside the container. The rotational speed of the rotating shaft 2 is controlled with rotational speed control means 26.

A valve 51 serving as means for releasing particles 6 is opened, with the container 1 maintained rotated at a prescribed rotational speed, to unleash the particles from a particle supply cylinder 5 in the direction in which the centrifugal force is exerted within the fan-shaped compartment 4. Since the limpid water is restrained within the compartment 4, the Coriolis force acts only on the particles 6 movable within the limpid water. The Coriolis force is a apparent force and the intensity thereof, i.e. the degree of force acting in the reverse rotation direction, is determined by the balance between the inertial force of the particles 6 and the viscosity of rotating water.

When being viewed from the exterior, the particles 6 gradually move outward by the centrifugal action while being rotated about the axis of the container 1. That is to say, the particles 6 move outward while tracing a spiral trajectory. Here, the centrifugal force acting in the centrifugal direction, as well as the gravitational force, depend both on the specific gravities of the particles 6 and on the particle diameters thereof.

On the other hand, the force acting on the particles 6 in the rotation direction (strictly, tangential direction in rotation) consists mainly of the drag force of water. This is a force acting to move the particles 6 in the same direction as the water rotation by the difference in speed between the particles and the water to be made by the water rotation. That is to say, the drag force of the water to the particles is a force having nothing to do with the specific gravities of the particles 6, but depending only on the volume of the particles.

In a centrifugal field in which a centrifugal action acts, the particles 6 move in the rotation direction as accompanied by the water and increase their speed in the rotation direction in proportion as they move outward. Thus, the water drag force is exerted on the particles 6. Here, while the particles having the same particle diameter receive drag force varying depending on the difference in speed in the rotation direction between the water and the particles, the particles having a certain diameter exhibit a small difference in speed between the particles having a difference in specific gravity, and small-gravity particles 8 having a small mass exhibit a larger change in state of movement. That is to say, when comparing movements of large-gravity particles 7 and the small-gravity particles 8 within the same period of time, the small-gravity particles are well accompanied by the water, whereas the large-gravity particles are difficult to be accompanied by the water (the larger the specific gravity of the particles, the later the movement of the particles as accompanied by the water is).

Figure 2:
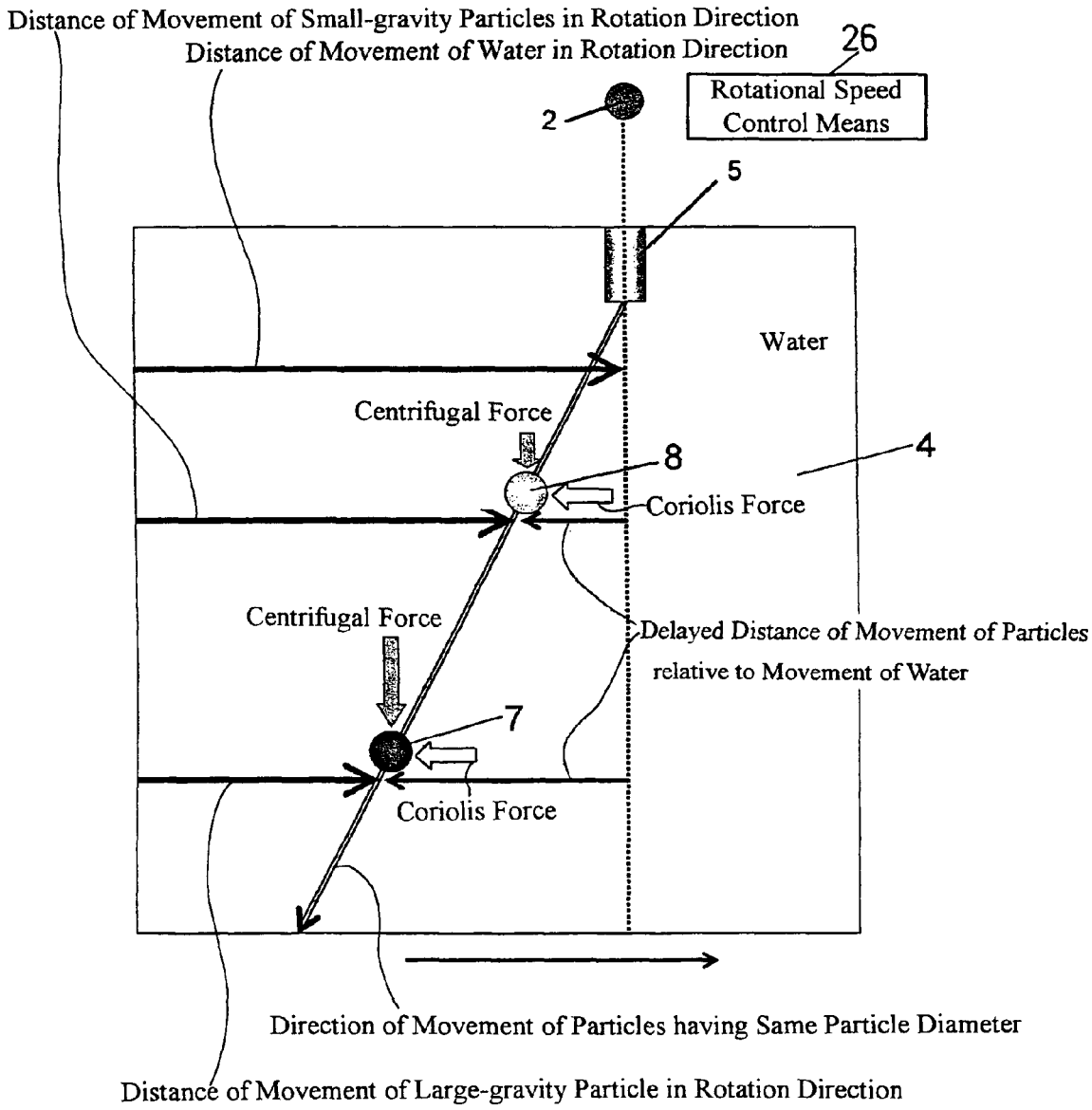
FIG. 2 is an explanatory view showing the movement of particles within a centrifugation vessel in a disc-shaped container, as viewed from above, in the fundamental configuration and operation of the apparatus and method according to the present invention.

During the movements of the particles, however, the speed of the small-gravity particles 8 in the centrifugal direction is lower than that of the large-gravity particles 7. That is to say, as shown in FIG. 2, by tingeing the difference in speed in the rotation direction caused by receiving the same degree of drag force and the difference in speed in the centrifugal direction caused by receiving different centrifugal forces in the case of the particles having different specific gravities but having the same particle diameter, the speed in the centrifugal direction is later in the case of small-gravity particles 8 than in the case of large-gravity particles 7 while there is a case where the speeds along the trajectory of the movements, i.e. in the direction of movements, become substantially the same.

When all the particles comply with these conditions, the arrangement of the particles as shown in FIG. 3(*b*) can be obtained. Actually, however, since the difference in drag force in the rotation direction varies depending mainly on the particle diameter of the particles, the arrangement shown in FIG. 3(*b*) can be obtained only when the particles have fallen in a certain range of particle diameters.

As described above, though the present invention and JP-A 2006-239678 have the configuration and principle in common with each other, the characteristic features of the present invention are described hereinafter. While the ranges of particle diameters in JP-A 2006-239678 vary depending on combinations of particles having different specific gravities, verification experiments conducted for a combination of glass particles having a specific gravity of about 2.5 and zirconia particles having a specific gravity of about 6.1, using 3500 rpm, revealed that the particles having a diameter of around 100 μm entered in pockets 42*b* and 43*b* as shown in FIG. 3(*b*) irrespective of the difference in specific gravity.

Under the same conditions as in the verification experiments, in the region of the particle diameters of more than about 200 μm, the distance of movement of the large-gravity particles 7 in the reverse rotation direction is larger as shown in FIG. 3(*c*) than that of the small-gravity particles 8 in the same direction.

In the particles having the same specific gravity, the larger the particle diameter, the larger the distance of movement is. Therefore, the one-stage process enables the particles to be separated according to the specific gravities and, at the same time, the particles of each specific gravity to be separated according to the particle diameters. That is to say, in FIG. 3(*c*), the large-gravity particles 7 having a large particle diameter were separated to enter pockets 41 and the large-gravity particles 71 and 72 having small particle diameters were separated to enter pockets 42 and 43, and the small-gravity particles 8 having a large particle diameter were separated to enter pockets 43 and the small-gravity particles 81 and 82 having small particle diameters were separated to enter pockets 44 and 45.

The above tendency is made conspicuous in proportion as the particles diameter becomes large and as the rpm of the disc-shaped container becomes high. Therefore, the threshold value making the arrangement of particles as shown in FIG. 3(*c*) varies depending on the separation conditions (particle diameters and container rpm).

Furthermore, in the samples used in the verification experiments, when conducting the particle separation, with the disc-shaped container rotated at relatively low rpm (around 700 rpm, for example), it was confirmed from calculation that there were conditions under which the distance of movement of the large-gravity particles 7 and particles 72 having a particle diameter of approximately 50 μm or less in the reverse rotation direction was made smaller, as shown in FIG. 3(*d*), than that of the small-gravity particles 8 and particles 82 having a particle diameter of approximately 50 μm or less in the same direction.

The presence of the aforementioned conditions as regards the movement of the particles in the x direction has been confirmed through calculation using the Runge-Kutta-Gill method to solve the following particle equation of motion (BBO-Equation) with respect to the particle motion on the X-Y plane in the inertial system. Incidentally, the particle motion in the y direction can be expressed by an equation having the variable x in the following equation displaced with y.

$$\frac{d^2x}{dt^2} = \frac{3}{4}\frac{\rho_f}{d(\rho_p + x\cdot\rho_p)}\frac{24(1+0.1806Re^{0.6459}}{Re} + \frac{0.4251}{1+\frac{6880.95}{Re}}(u_x - v_x)|u_x - v_x| + \frac{(1+x)\rho_f}{\rho_p + \chi\rho_f}(-\omega^2 x),$$

wherein d stands for a particle diameter, x for a position in the x direction, $\rho_p$ for a particle density, $\rho_f$ for a water density, Re for the Reynolds number, $u_x$ for a water speed in the x direction, $v_x$ for a particle speed in the x direction, $\chi$ for an additional mass coefficient (adopted was 0.5) and $\omega$ for a water angular speed.

Figure 5:
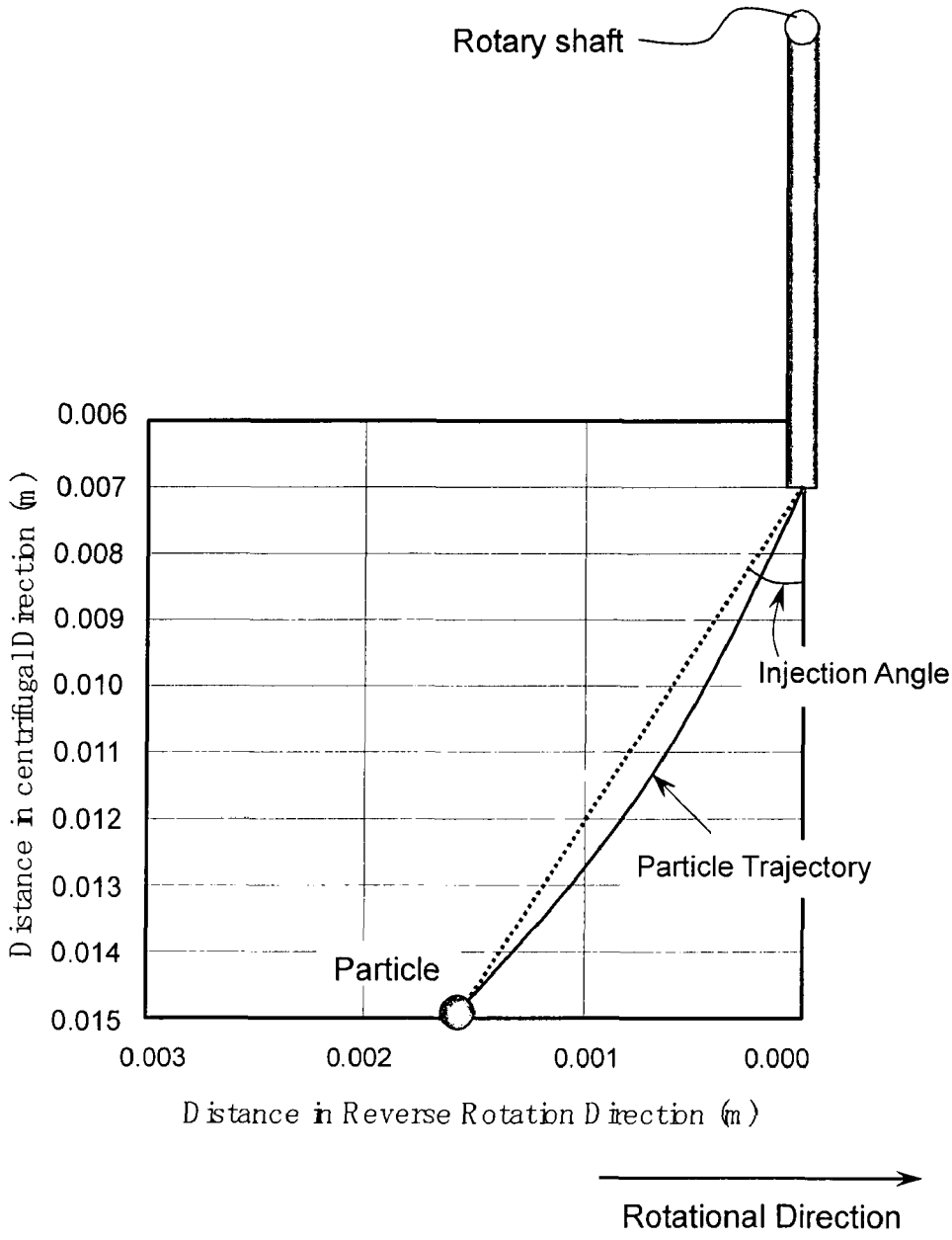
FIG. 5 is an explanatory view showing an example of calculating the particle trajectory when a particle has been injected from a nozzle tip 0.007 m distant from a rotary shaft.

According to the above differential equation, it is made possible to obtain a particle trajectory gyratory from the center to the outside. Since the water and water tank undergo the same rotary motion under conditions of the present invention, when the rotary motion is converted to a rotating coordinate system with the rotary shaft 2 as the standard, the particle trajectory as shown in FIG. 5 can be obtained. FIG. 5 is an explanatory view showing an example of calculating the particle trajectory when a particle has been injected from a nozzle tip 0.007 m distant from a rotary shaft assuming that the rotation is made from the left side to the right side, with the rotary shaft 2 as the center.

Figure 6:
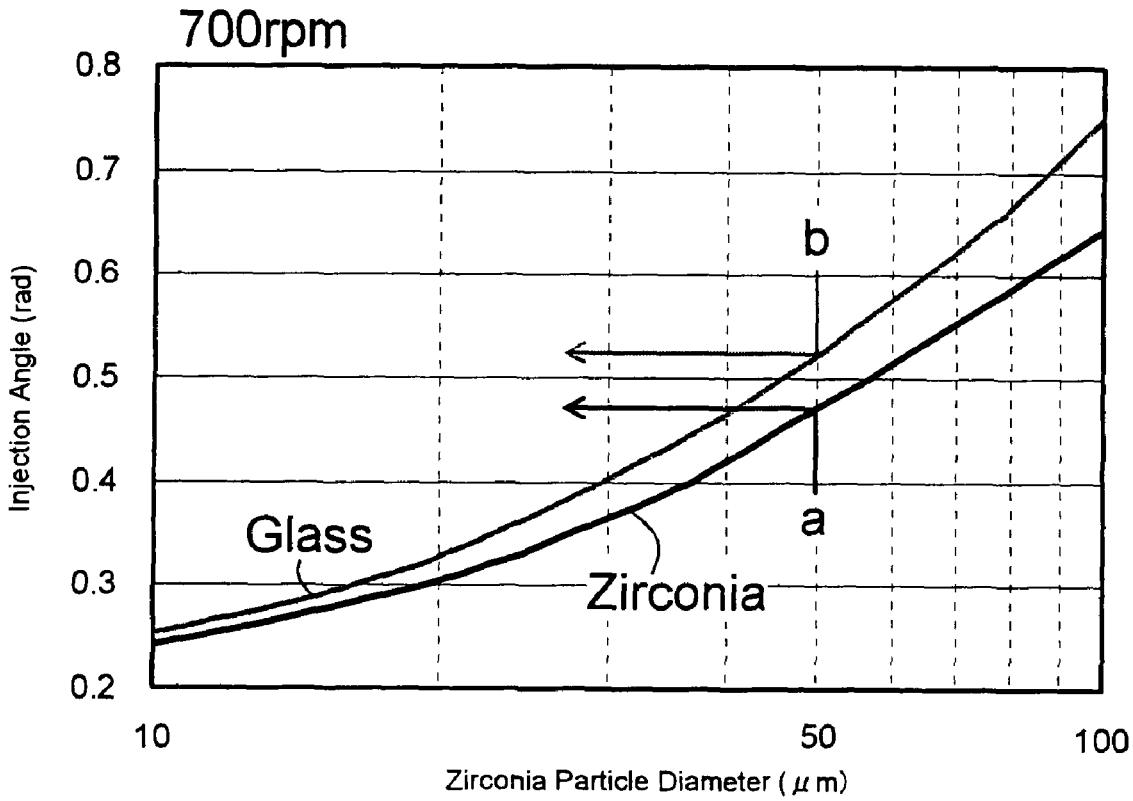
FIG. 6 is an explanatory view showing the results of calculation of the relationship between the particle diameters and the injection angles assumed when a water tank has been rotated at 700 rpm, in which spherical zirconia particles having a specific gravity of 6.1 and spherical glass particles having a specific gravity of 2.49 and settling down in water kept stationary at the same speed as the zirconia particles have been introduced.

FIG. 6 is an explanatory view showing the results of calculation of the relationship between the particle diameters (μm) and the injection angles (rad) assumed when a water tank has been rotated at 700 rpm, in which spherical zirconia particles having a specific gravity of 6.1 and spherical glass particles having a specific gravity of 2.49 have been introduced. The abscissa axis in FIG. 6 directly shows the size of the particle diameter of the spherical zirconia particles, provided that it actually shows the particle diameter of the spherical zirconia particles having the equal settling ratio relative to the spherical glass particles.

The results of calculation vary depending on the specific gravity of the particles, diameter of particles, rpm of the water tank, distance of the particle release point (length of the nozzle, for example), etc. For this reason, though FIG. 6 merely shows one example of calculation, in spite of the fact the zirconia particles having a diameter of 50 μm and glass particles having a diameter of 93 μm settle down in water kept stationary at the same speed as shown by points a and b in FIG. 6, it is found that their angles of injection from the nozzle tip differ from each other. In this case, it is also found that the glass particles having low specific gravities are released to positions outward of those to which the zirconia particles having higher specific gravities are released, i.e. positions in the direction opposed to the rotation direction.

If a countermeasure for preventing water convection from being slightly generated in a water tank is devised as by installing a current plate in the water tank to materialize an ideal separation state, it is theoretically made possible to separate fine particles according to the specific gravities thereof.

When adopting the principle described above as the particle separation apparatus and method, i.e. when controlling rpm so that a distance of relative movement in the rotation direction between large-gravity particles and small-gravity particles may be adjusted, it is made possible to separate, with high precision, polydisperse fine particles containing various kinds of particles having different specific gravities according to their specific gravities or according to both their specific gravities and their particle diameters.

Figure 4:
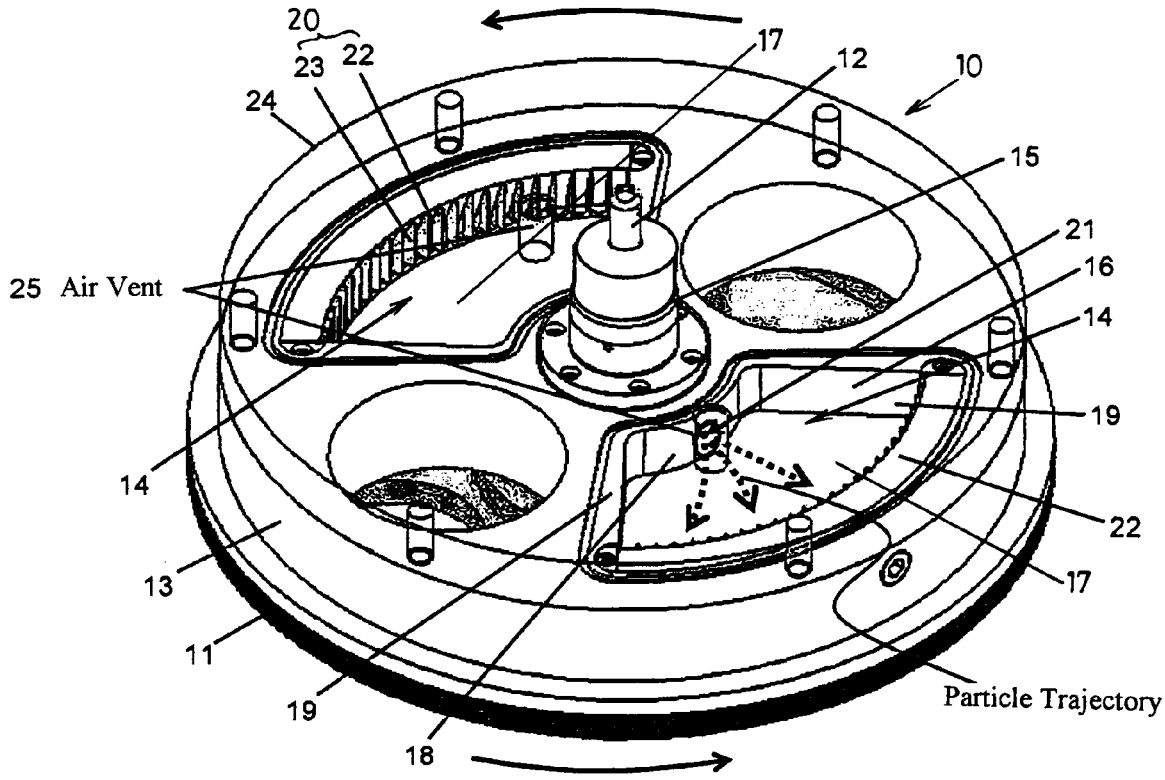
FIG. 4 is an explanatory view showing the particle separation apparatus and method in Example 1 according to the present invention.

FIG. 4 illustrates the particle separation apparatus and method in Example 1 according to the present invention. In a particle separation apparatus 10 of Example 1, a disc-shaped container 13 is disposed on a stationary base 11 so that it may be rotated around a support shaft 12 projecting from the base 11 with a drive means, such as a motor.

Paired fan-shaped centrifugation vessels 14 are formed in the disc-shaped container 13 symmetrically with the support shaft 12 as the center. Each of the number of the fan-shaped centrifugation vessels 14 to be provided in the disc-shaped container 13 and the number of places where the fan-shaped centrifugation vessels 14 are to be disposed may be single or plural and is merely a matter of design consideration to be appropriately determined in consideration of the scale of the disc-shaped container 13, the amount of particles to be subjected to separation treatment, etc.

What is provided around the support shaft 12 at the center of the disc-shaped container 13 is a suspension supply tank 15 for accommodating a suspension having particles to be separated mixed in liquid and supplying it to the fan-shaped centrifugation vessels 14 (corresponding to the fan-shaped compartment 4 in the fundamental configuration).

The fan-shaped centrifugation vessel 14 comprises an inner circumferential wall 16 and a bottom wall 17 that define a dent. The inner circumferential wall 16 comprises an inner wall 18, an opposed outer wall 20 and a pair of opposed, circumferentially defining walls (sidewalls) 19 integrally formed contiguously. The fan-shaped centrifugation vessel 14 is filled with liquid, such as water, that is restrained within the fan-shaped centrifugation vessel 14 so as not to flow out of the vessel 14 even when the disc-shaped container 13 is rotating.

The inner wall 18 of the fan-shaped centrifugation vessel 13 is provided with a particle supply cylinder (nozzle) 21 communicating with the suspension supply tank 15. The particles contained in the suspension packed in the suspension supply tank 15 can be supplied from the particle supply cylinder 21 into the fan-shaped centrifugation vessel 14.

The inner surface of the outer wall 20 of the fan-shaped centrifugation vessel 14 has a plurality of particle collection pockets 22 arranged in the circumferential direction. The pockets 22 are divided from adjacent pockets 22 by partition walls 23. Separated particles are to be collected in the series of plural pockets 22. The open upper ends of the fan-shaped centrifugation vessels 14 may be covered with a lid 24 provided with air vents 25 via which the interiors of the fan-shaped centrifugation vessels 14 communicate with the atmospheric air.

The operation of the particle separation apparatus and method having the aforementioned configuration will be described. Water is introduced beforehand into the suspension supply tank 15 in order to prevent turbulence of water in the fan-shaped centrifugation vessels 14, and the water is deprived of air bubbles from the air vents 25. The air vents 25 are then stopped up with plugs, and the apparatus is brought in a tightly sealed state, with only suspension introduction ports (not shown) of the suspension supply tank 15 kept opened.

The disc-shaped container 13 initiates its rotation and is rotated until the rpm thereof is constantly stabilized, and valves (not shown) shutting off between the suspension supply tank 15 and the particle supply cylinders 21 are opened to release the particles via the particle supply cylinders 21 into the fan-shaped centrifugal vessels 14, the number of which is two in FIG. 3.

Incidentally, though it is not particularly shown how the suspension is supplied, a configuration can advantageously be adopted, in which the suspension supply tank 15 is disposed above the disc-shaped container 13, at the center of which a supply chamber is provided so that it communicates with the suspension supply tank 15 via a pipe through the particles in the suspension are dropped down into the supply chamber. The apparatus may be configured such that the water containing in the particle collection pockets 22 is discharged out of the apparatus together with the particles.

When supplying the particles into the centrifugation vessels 14, it is important that the particles be released, to the utmost, from the same point of the particle supply cylinder 21. At this time, when the particle supply cylinder 21 has a large diameter or the turbulence of the water in the centrifugation vessel 14 is vigorous, the particles released into the centrifugation vessel are ready to diffuse to lose the effect of separating the particles according to their particle diameters. That is to say, the smaller the inside diameter of the particle supply cylinder, the better the particle separation precision is.

Figure 7:
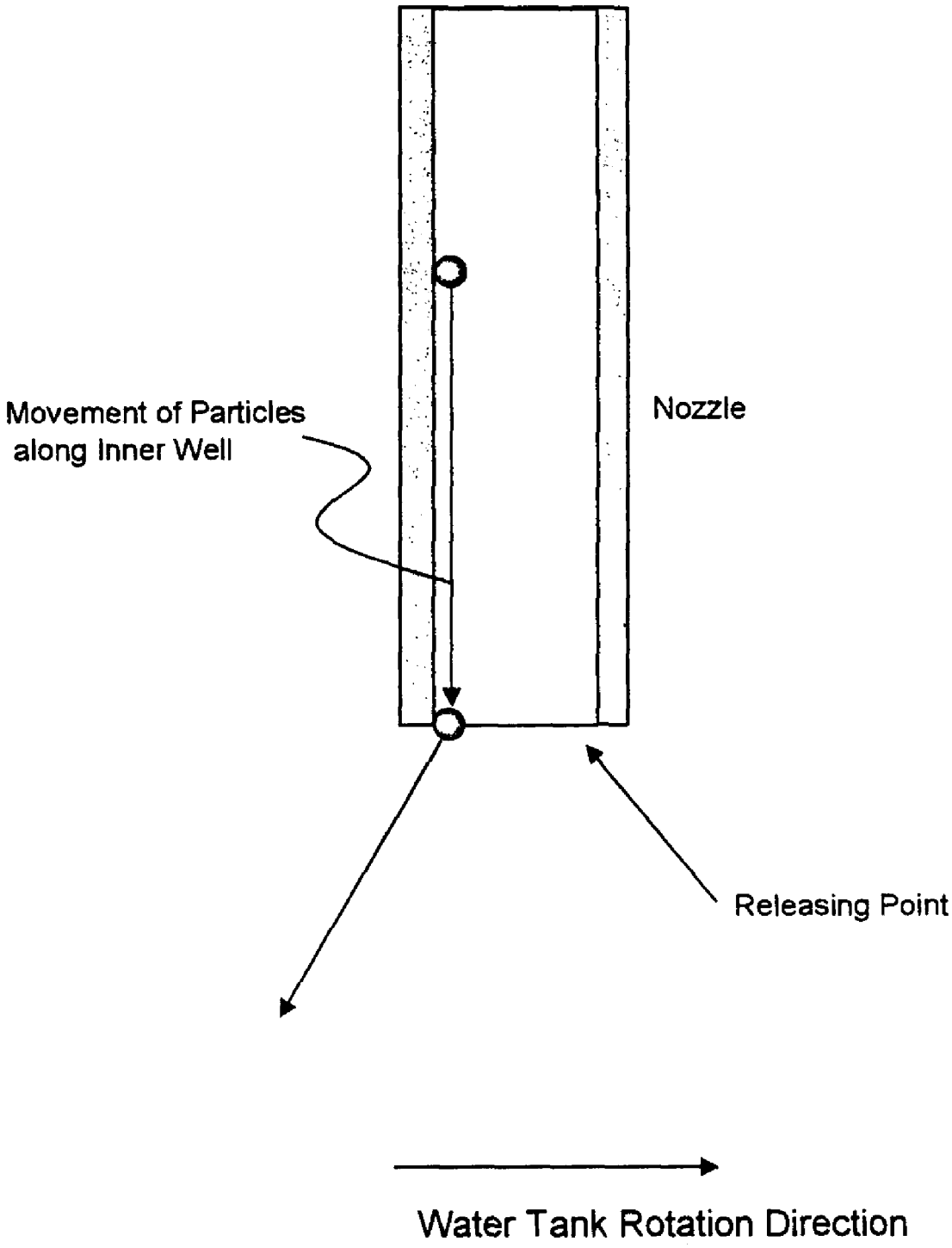
FIG. 7 is an explanatory view showing the movement of a particle within the nozzle.

In the present invention, since the particles that have been injected into the water tank at a prescribed injection angle are collected in the pockets at different positions on the circumference to make separation of the particles contained in the suspension, it is desirable that the conditions under which the particles are injected be preferably the same. Since the particles moving within the nozzle in the centrifugal direction receive the Coriolis force in the reverse rotation direction, when the ratio of the nozzle diameter to the particle diameter falls within around 200, the moving particles fetch up the release point as pressed against the inner wall of the nozzle opposed to the inner wall thereof in the rotation direction, as shown in FIG. 7. When the ratio is unduly large, the points at which the particles are injected may possibly be not the same.

In the case of the particles having an average particle size of 1 mm, for example, it is conceivable that the particles are injected at substantially the same point insofar as the inside diameter of the nozzle falls in the range of 1 mm to 5 mm. When using a nozzle having an inside diameter of around 10 cm that is much larger than the particle diameter, due to the generation of water convection within the nozzle, there is a fair possibility of the particles being prevented from being injected from the same point.

Furthermore, it is desirable that the water in the centrifugation vessel be kept stationary relative to the centrifugation vessel. Particularly, in the case of separating fine particles having small inertial force according to their specific gravities in the embodiment shown in FIG. 3(*d*), the water in the paths through which the fine particles within the centrifugation vessel pass has to be kept completely stationary relative to the centrifugation vessel.

According to the particle separation method of the present invention, as described above, it is made possible to separate theoretically completely (at a separation coefficient of approximately 100%) according to particle specific gravities and particle diameters with a one-stage process polydisperse fine particles of several micrometers or more having a particle size width difficult to have conventionally separated.

The particle separation apparatus and method of the present invention have been described in the foregoing citing the example. It goes without saying that the present invention is not limited to the example and may variously be modified without departing from the technical scopes of appended claims.

The particle separation apparatus and method of the present invention for separating particles contained in a suspension according to the particle diameters or specific gravities can be applied to various industrial fields (manufacturing steps in the fields of the mining industry and other industries, and particle separation steps in the recycling and environment-restoring processes)

What is claimed is:

1. A method for separating particles contained in a suspension using a disc-shaped container which is rotatable on a base at a constant rotational speed and which is provided with centrifugation vessels, comprising the steps of:

rotating the disc-shaped container on the base at a constant rotational speed;

releasing the suspension into the centrifugation vessels filled beforehand with water; and changing a distance of relative movement in a rotation direction between large-gravity particles and small-gravity particles by controlling the rotational speed, thereby separating in the disc-shaped container the particles contained in the suspension according to specific gravities or particle diameters of the particles.

2. A method according to claim 1, wherein the suspension is released via a particle supply cylinder of the disc-shaped container into the centrifugation vessels.

3. A method according to claim 1 or claim 2, further comprising the step of heightening the rpm to make a distance of movement of the large-gravity particles in a reverse rotation direction larger than that of the small-gravity particles and to make a distance of movement of the particles of same specific gravity in a reverse rotation direction larger in proportion as a particle diameter of the particles is increased, thereby enabling separation of the particles contained in the suspension according to the specific gravities or particle diameters of the particles.

4. A method according to claim 1 or claim 2, further comprising the step of lowering the rpm to make a distance of movement of the small-gravity particles in a reverse rotation direction larger than that of the large-gravity particles and to make a distance of movement of the particles of same specific gravity in a reverse rotation direction larger in proportion as a particle diameter of the particles is increased, thereby enabling separation of the particles contained in the suspension according to the specific gravities or particle diameters of the particles.

* * * * *